United States Patent [19]

Reiland

[11] 4,188,010

[45] Feb. 12, 1980

[54] CASTING RISERS

[75] Inventor: Dennis J. Reiland, St. Paul, Minn.

[73] Assignee: General Foundry Products Corporation, St. Paul, Minn.

[21] Appl. No.: 828,232

[22] Filed: Aug. 26, 1977

[51] Int. Cl.[2] ..... B22C 9/00

[52] U.S. Cl. ..... 249/197; 164/359

[58] Field of Search ..... 164/133, 349, 359, 360, 164/363, 364; 249/105, 106, 197, 108

[56] References Cited

U.S. PATENT DOCUMENTS

| | | | |
|---|---|---|---|
| 1,794,840 | 3/1931 | Egler | 249/106 |
| 3,513,904 | 5/1970 | Lane | 164/360 X |
| 3,815,665 | 6/1974 | Baur | 164/360 X |

FOREIGN PATENT DOCUMENTS

| | | | |
|---|---|---|---|
| 660284 | 6/1965 | Belgium | 164/359 |
| 2428885 | 1/1976 | Fed. Rep. of Germany | 164/360 |
| 745559 | 5/1933 | France | 249/106 |

*Primary Examiner*—Robert D. Baldwin
*Assistant Examiner*—Gus T. Hampilos
*Attorney, Agent, or Firm*—Jacobson and Johnson

[57] ABSTRACT

An improved casting riser is provided of two different materials, an upper portion having a low thermal conductivity for retaining the heat of the metal in the riser liner and a lower portion having a high thermal conductivity to allow transfer of heat between the molten metal in the riser liner and the molten metal in the mold.

6 Claims, 1 Drawing Figure

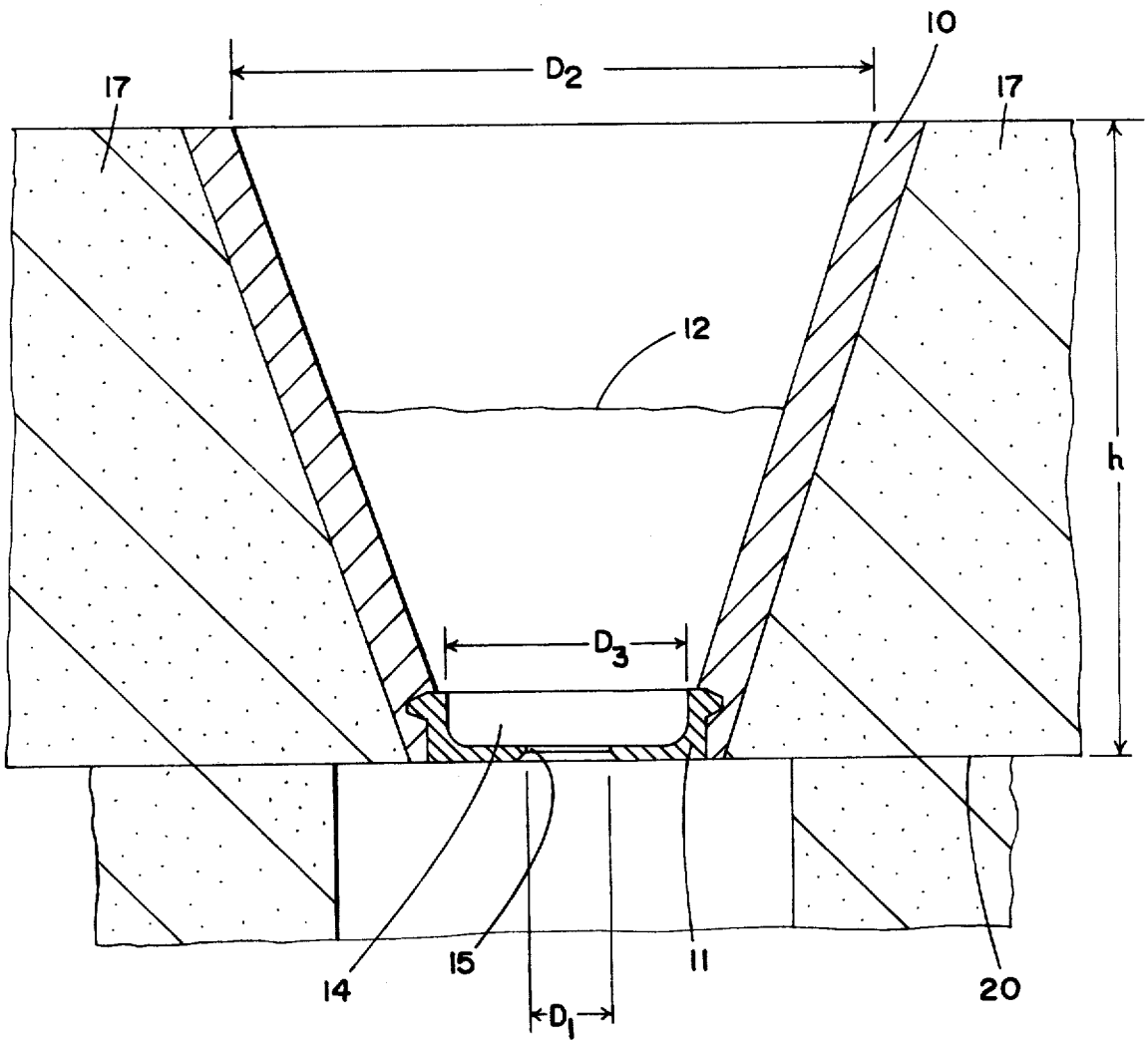
10
17
17
$D_2$
12
h
$D_3$
14
15
11
20
$D_1$

CASTING RISERS

BACKGROUND OF THE INVENTION

1. Field of the Invention.

This invention relates generally to metal foundry articles and, more specifically, to improvements for riser linings in metal foundry castings.

2. Description of the Prior Art.

The manufacture of cast metal articles in foundries is well known in the art. Typically, one pours molten metal into a two-part mold where the metal gradually cools and hardens. Because molten metal shrinks during the cooling process, it is necessary to provide a reservoir of molten metal to flow into the shrinkage voids in the casting as the metal cools. The reservoirs of molten metals are known as risers. The concepts of risers in molds is well known in the art. The concepts of different types of riser liners are well known in the art. An example of a typical riser liner is shown in the Washburn U.S. Pat. No. 900,970. Washburn shows a one-piece riser liner made out of clay and suggests that the riser liner could be made of asbestos, wood or metal. A type of restriction device for use in sand castings is shown in Nieman U.S. Pat. No. 3,831,662. Nieman shows a frangible member located between the cope and the drag of the castings but not as part of a riser liner. The frangible member allows flow of metal therethrough as well as to facilitate clean removal of the solidified metal in the riser liner. The structure in the Nieman U.S. Pat. No. 3,831,662 comprises a frangible thin wall member made from a ceramic material. Nieman's purpose of using a frangible thin wall member is for breaking the solidified metal in the riser free from the casting after solidification and for controlling the amount of metal flowing into the mold.

BRIEF SUMMARY OF THE INVENTION

Briefly, the present invention comprises a frustoconical shape riser having an upper portion made from an insulating material, i.e., low thermal conductivity, and a bottom section having a higher thermal conductivity which allows transfer of heat between the metal in the riser and the metal in the mold. The two different materials coact to provide a supply of molten metal to the mold during the solidification process with a minimum amount of waste metal.

BRIEF DESCRIPTION OF THE DRAWING

The drawing shows a vertical section view of the two-part riser liner.

DETAILED DESCRIPTION OF THE INVENTION

Referring to the drawing, reference numeral 10 generally designates the upper portion of a frusto-conical shaped riser liner which is made of an insulation material. Typical of the materials used to make riser liner 10 are a combination of silica and alumina. An example is a riser liner comprised of about 46% silica and about 42% alumina with the balance trace materials. This type of liner has a K value of 0.07. Located at the bottom of riser liner 10 is a frangible member 11 having a lower opening of diameter $D_1$. The frangible member 11 has an upper opening 14 that necks down into the smaller diameter opening 15, which is denoted by dimension $D_1$. On the outside of riser liner 10 is sand 17, and on the inside of riser 10 is a supply of molten metal 12. The topmost diameter of the riser is indicated by diameter $D_2$ and the height of the riser is indicated by h. Typical of dimensions of a riser are h equals 6 inches, and $D_1$ equals ¾inch. The insulating valve or thermal conductivity of riser material 10, if made from the combination of silica and alumina, is 0.072. This is denoted as K. (B.T.U. per hour, square foot, and temperature gradient of 1 degree fahrenheit per inch thickness). Sand 17, has a K value of approximately 0.6–1.2. The lower portion 11 is typically made from a ceramic material or other material which has a thermal conductivity in the same order as the molten metal. For most metals it is preferred that lower portion 11 have a value of K of 3 or greater. This corresponds closely to the conductive value K or most molten metals which are usually greater than 3.

With the present invention it will be noted that the diameter $D_1$ is substantially smaller than diameter of riser liner $D_3$. This allows for a very small opening between the metal riser liner and the mold. This offers an advantage in that it is an easier task for one to cut the solidified metal in the riser liner from the mold. It has been found that because lower section 11 has essentially the same thermal conductivity as the metal it therefore conducts heat freely from the metal and the riser liner into the mold. Heat loss through the top portion 10 is minimized and reduced through the conical shape and the lower thermal conductivity which prevent the rapid loss of heat to the sand that would cause premature solidification of the metal in the riser liner. With a riser liner having an insulated upper portion and a lower conducting portion, it has been found that one can reduce the excess amount of molten metal poured in the riser liner as well as the size of the riser. For example, a typical prior art cylindrical riser of a single material must have a minimum bottom opening of approximately 2 inches and a height of 10 inches to be equivalent to the present invention which has a height of 6 inches and a minimum opening of ¾ inches.

In general, the greater the insulating value of the upper liner and the closer the thermal conductivity of the metal to the bottom section of the riser liner, the better the riser liner will perform.

While the embodiment shown is frusto conical, other shapes such as spherical or cylindrical are also suitable. With spherical or closed risers the molten metal is not introduced in the riser except through the mold.

I claim:

1. A riser liner operable for inserting into a mold containing a mold material said riser liner comprising an upper section formed from a material having a thermal conductivity less than the mold material; and a lower section adjoining said upper section and having an opening therein, said lower section formed from a material which has a thermal conductivity which is greater than the thermal conductivity of said upper section with the thermal conductivity of said lower section being on the order of the thermal conductivity of molten metal poured into said riser liner, said lower section mounted partially in said upper section so that when said upper section is placed in a mold only said upper section is in contact with the mold material in the mold to thereby prevent the rapid loss of heat from the molten metal to the mold material through said lower section.

2. The invention of claim 1 wherein the thermal conductivity of said upper portion is less than 1 B.T.U. per hour, square feet, and temperature gradient of 1° F. per inch thickness.

3. The invention of claim 2 wherein the thermal conductivity of said lower portion is about 3 B.T.U. per hour, square feet, and temperature gradient of 1° F. per inch thickness.

4. The invention of claim 1 wherein said upper portion is frusto conical.

5. The invention of claim 1 wherein said lower section comprises a ceramic material.

6. The invention of claim 5 wherein the upper portion is made from silica and alumina.

* * * * *